US009564254B2

(12) United States Patent
Kobayashi et al.

(10) Patent No.: US 9,564,254 B2
(45) Date of Patent: Feb. 7, 2017

(54) ALUMINUM ALLOY WIRE, AND ALUMINUM ALLOY TWISTED WIRE, COVERED ELECTRICAL WIRE AND WIRE HARNESS USING THE SAME

(75) Inventors: Hiroyuki Kobayashi, Osaka (JP); Yoshihiro Nakai, Osaka (JP); Taichiro Nishikawa, Osaka (JP); Yoshiyuki Takaki, Osaka (JP); Misato Kusakari, Osaka (JP); Yasuyuki Otsuka, Yokkaichi (JP)

(73) Assignees: SUMITOMO ELECTRIC INDUSTRIES, LTD., Osaka (JP); AUTONETWORKS TECHNOLOGIES, LTD., Mie (JP); SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 13/995,066

(22) PCT Filed: Apr. 3, 2012

(86) PCT No.: PCT/JP2012/059050
§ 371 (c)(1),
(2), (4) Date: Jun. 17, 2013

(87) PCT Pub. No.: WO2012/141041
PCT Pub. Date: Oct. 18, 2012

(65) Prior Publication Data

US 2013/0264115 A1 Oct. 10, 2013

(30) Foreign Application Priority Data

Apr. 11, 2011 (JP) ..... 2011-086989
Mar. 9, 2012 (JP) ..... 2012-052569

(51) Int. Cl.
*H01B 1/02* (2006.01)
*C22C 21/08* (2006.01)
(Continued)

(52) U.S. Cl.
CPC ..... *H01B 1/023* (2013.01); *C22C 21/00* (2013.01); *C22C 21/02* (2013.01); *C22C 21/06* (2013.01);
(Continued)

(58) Field of Classification Search
CPC ..... H01B 1/023; C22C 21/08
See application file for complete search history.

(56) References Cited

U.S. PATENT DOCUMENTS 8,353,993 B2 * 1/2013 Kusakari et al. ..... 148/440
2010/0071933 A1 * 3/2010 Otsuka et al. ..... 174/128.1
(Continued)

FOREIGN PATENT DOCUMENTS

JP 08277447 A * 10/1996
JP 2004134212 A 4/2004
(Continued)

OTHER PUBLICATIONS

Extended European Search Report for EP Application No. 12770674.5 mailed Oct. 28, 2013, 5 pages.
(Continued)

*Primary Examiner* — Roy King
*Assistant Examiner* — Janelle Morillo
(74) *Attorney, Agent, or Firm* — Ditthavong & Steiner, P.C.

(57) ABSTRACT

An aluminum (Al) alloy wire, which is an extra fine wire having a wire diameter of 0.5 mm or less, contains, in mass %, Mg at 0.03% to 1.5%, Si at 0.02% to 2.0%, at least one element selected from Cu, Fe, Cr, Mn and Zr at a total of 0.1% to 1.0% and the balance being Al and impurities, and
(Continued)

has an electrical conductivity of 40% IACS or more, a tensile strength of 150 MPa or more, and an elongation of 5% or more. By producing the extra fine wire from an Al alloy of a specific composition containing Zr, Mn and other specific elements, though the extra fine wire is extra fine, it has a fine structure with a maximum grain size of 50 μm or less and is superior in elongation.

6 Claims, 1 Drawing Sheet

(51) Int. Cl.

| | |
|---|---|
| ***C22C 21/00*** | (2006.01) |
| ***C22C 21/02*** | (2006.01) |
| ***C22C 21/06*** | (2006.01) |
| ***H01B 5/08*** | (2006.01) |
| ***H01B 7/00*** | (2006.01) |
| ***C22F 1/00*** | (2006.01) |
| ***C22F 1/04*** | (2006.01) |
| ***C22F 1/05*** | (2006.01) |

(52) U.S. Cl.
CPC ..... *C22C 21/08* (2013.01); *C22F 1/00* (2013.01); *C22F 1/04* (2013.01); *C22F 1/05* (2013.01); *H01B 5/08* (2013.01); *H01B 7/00* (2013.01); *H01B 7/0045* (2013.01)

(56) References Cited

U.S. PATENT DOCUMENTS

| | | | | |
|---|---|---|---|---|
| 2011/0132659 | A1* | 6/2011 | Kusakari et al. ..... | 174/72 A |
| 2013/0264115 | A1 | 10/2013 | Kobayashi et al. | |

FOREIGN PATENT DOCUMENTS

| | | | |
|---|---|---|---|
| JP | 2008-112620 | A | 5/2008 |
| JP | 2010043303 | A | 2/2010 |
| JP | 2010163675 | A | 7/2010 |
| JP | 2010265509 | A | 11/2010 |
| JP | 2011-001602 | A | 1/2011 |
| JP | 4646998 | B2 | 3/2011 |
| JP | 5155464 | B2 | 3/2013 |
| WO | 2008053897 | A1 | 5/2008 |
| WO | 2010018647 | A1 | 2/2010 |
| WO | WO 2010018646 | A1 * | 2/2010 |

OTHER PUBLICATIONS

Office Action for corresponding Korean Application No. 10-2013-7015763, dated Nov. 26, 2014, 9 pages.

* cited by examiner (A) SAMPLE No. 1
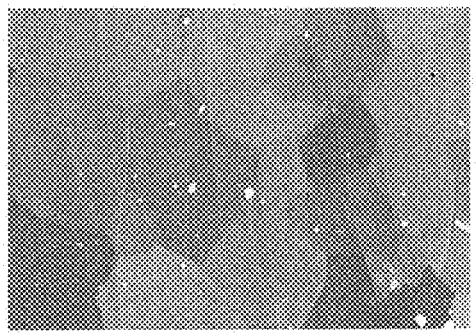
10 μm
(B) SAMPLE No. 11
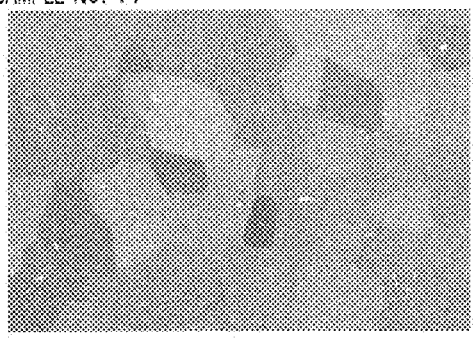
30 μm
(C) SAMPLE No. 16
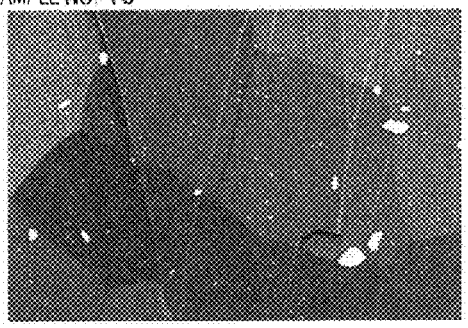
10 μm
(D) SAMPLE No. 102
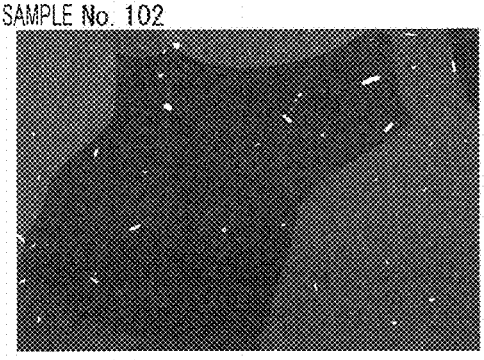
120 μm

ALUMINUM ALLOY WIRE, AND ALUMINUM ALLOY TWISTED WIRE, COVERED ELECTRICAL WIRE AND WIRE HARNESS USING THE SAME

TECHNICAL FIELD

The present invention relates to an aluminum alloy wire and an aluminum alloy twisted wire to be used as a conductor of an electrical wire, a covered electrical wire which has the aluminum alloy wire, the aluminum alloy twisted wire or a compression wire obtained by compression molding the aluminum alloy twisted wire to serve as the conductor, and a wire harness including the covered electrical wire; and particularly relates to an aluminum alloy wire which is extra fine, has a high strength and a high electrical conductivity and is meanwhile superior in elongation.

BACKGROUND ART

Hitherto, a plurality of electrical wires having a terminal are bundled together and are used in the form of a so-called wire harness in a wiring structure of electrical devices including a transportation device such as a motor vehicle or the like and a control device such as an industrial robot or the like. As the constituting material of a conductor for the electrical wire of the wire harness, copper containing materials such as copper, copper alloy and the like superior in electrical conductivity are mainly used.

Recently, accompanied with the rapid development of high performance and high functionality on motor vehicles, various types of electrical devices, control devices and the like to be mounted in the motor vehicles are increasing, which thereby brings about an increasing trend of electrical wires to be used in the mentioned devices. In the meanwhile, in recent years, in order to improve fuel efficiency of a transportation device such as a motor vehicle or the like so as to respond ecologically to the environment, it is strongly desired to make such transportation device lighter in weight.

As a lightweight solution to the electrical wires, it has been considered to use an aluminum electrical wire in which aluminum having a specific weight of about ⅓ of copper is used as the conductor. However, compared to the copper containing materials, pure aluminum is inferior in both impact resistance and flexing characteristics. Therefore, if a pure aluminum electrical wire is applied, for example, in dynamic locations such as a door section where open and close operations are performed, a section around an engine subjected to vibrations and the like, it is possible that the pure aluminum electrical wire may break earlier than expected. Thereby, the application of pure aluminum electrical wires is limited to wires of vehicular accessories in a static location which is substantially immobile after installation or in a low-temperature location having a temperature from room temperature to no more than 50° C.

Meanwhile, Japanese Patent No. 4646998 (PTL 1) has disclosed the fabrication of an aluminum alloy wire which has a high strength and a high electrical conductivity and is superior in impact resistance by performing a softening treatment on the wire after elongation and the application of the aluminum alloy wire having a high strength and a high toughness as the conductor of electrical wires in vehicular wire harness. Since the aluminum alloy wire is superior in impact resistance, it can be used in the dynamic locations mentioned in the above.

CITATION LIST

Patent Literature

PTL 1: Japanese Patent No. 4646998

SUMMARY OF INVENTION

Technical Problem

In recent years, electric wires are desired to be further light. Thereby, it is desired to develop an aluminum alloy wire which is an extra fine wire having a wire diameter of 0.5 mm or less, has a high strength, a high electrical conductivity and sufficient elongation so as to offer superior impact resistance and flexing characteristics. Such aluminum alloy wire is also desired to be superior in high-temperature characteristics when used in a high-temperature location such as a section around an engine, and more specifically such aluminum alloy wire is desired to have a high strength (superior in high-temperature strength) and be capable of maintaining the high strength even exposed to a high temperature for a long time (superior in a long-time heat resistance).

A 6000-series alloy (Al—Mg—Si alloy) is known as the high-strength aluminum alloy. Generally, by performing a solution treatment and an aging treatment on the 6000-series alloy, it is possible to offer it a high strength. Thus, the inventors of the present invention fabricated an extra fine wire having a wire diameter of 0.5 mm or less from the 6000-series alloy. However, the obtained wire had a high strength after the solution treatment and the aging treatment but lacked sufficient elongation.

Moreover, up to now, no extra fine aluminum alloy wire superior in both the high-temperature strength and the heat resistance has ever been fabricated.

Therefore, one object of the present invention is to provide an aluminum alloy wire which is an extra fine wire, has a high strength and a high electrical conductivity and is meanwhile superior in elongation, and an aluminum alloy twisted wire. Another object of the present invention is to provide an extra fine aluminum alloy wire and an aluminum alloy twisted wire superior in a high-temperature strength and a heat resistance.

Further, another object of the present invention is to provide a covered electrical wire including a conductor which is an extra fine wire, has a high strength and a high electrical conductivity and is meanwhile superior in elongation, and a wire harness including the covered electrical wire. Furthermore, another object of the present invention is to provide a covered electrical wire including a conductor which is extra fine and lightweight and superior in a high-temperature strength and a heat resistance, and a wire harness including the covered electrical wire.

Solution to Problem

After investigations on the extra fine wire fabricated from the Al—Mg—Si alloy, the inventors of the present invention found the presence of coarse crystal grains greater than 100 μm and even to about 300 μm in the extra fine wire. Since the wire diameter of the extra fine wire is 0.5 mm or less, the ratio of the coarse grains relative to the wire diameter of the wire is over 10%. It is considered that the coarse grains result in breaking and thereby a small elongation. Therefore, it is preferred that the extra fine wire is fabricated into such a structure that the coarse grains resulting in breaking are reduced, and preferably the coarse grains are substantially absent.

In order to reduce the coarse crystal grains, it has been considered to add at least one element of Ti and B which possess a refinement effect on crystal structures in casting. However, as illustrated by examples to be described hereinafter, the addition of Ti and B only did not offer sufficient elongation to the extra fine wire mentioned in the above. Therefore, the inventors of the present invention fabricated the extra fine wire from the aluminum alloy with various elements added to Al—Mg—Si alloy serving as the base material, and found that it is possible to obtain the aluminum alloy wire which has a structure of small maximum grain size and is superior in elongation by limiting the contents of specific elements to specific ranges. In addition, the inventors of the present invention found that by limiting specific element contents to specific ranges, it is also possible to obtain the aluminum alloy wire superior in the high-temperature strength and the heat resistance. The invention is accomplished on the basis of the above findings.

The aluminum (Al) alloy wire of the present invention is used as a conductor and is an extra fine wire having a wire diameter of 0.5 mm or less. The Al alloy wire contains, in mass %, Mg at 0.03% to 1.5%, Si at 0.02% to 2.0%, at least one element selected from Cu, Fe, Cr, Mn and Zr at a total of 0.1% to 1.0%, and the balance being Al and impurities. The Al alloy wire has an electrical conductivity of 40% IACS or more, a tensile strength of 150 MPa or more, an elongation of 5% or more, and a maximum grain size of 50 μm or less.

The above Al alloy wire of the present invention has a high strength since it is fabricated from Al—Mg—Si alloy and a high electrical conductivity since the contents of the additive elements are within specific ranges. By limiting the contents of specific elements such as Zr, Mn and the like to specific ranges, as mentioned in the above, the Al alloy wire of the present invention has a structure of small maximum grain size, i.e., a fine structure and is superior in elongation. Since the Al alloy wire of the present invention is an extra fine wire having a specific fine structure and has a high strength and a high electrical conductivity and sufficient elongation, it can be preferably used as a conductor material of an electrical wire requiring impact resistance and flexing characteristics. As illustrated by examples to be described hereinafter, the Al alloy wire of the present invention has a high strength even at a high temperature and is capable of maintaining the high strength even exposed to a high temperature for a long time, thereby, it is superior in the high-temperature strength and the heat resistance, which enables it to be preferably used as a conductor material of an electrical wire to be disposed in a high-temperature location.

Given as an aspect of the present invention, the Al alloy wire contains Zr at 0.01 mass % or more.

After investigations, the inventors of the present invention found that Zr has an effect of improving the elongation greatly even at a minute amount. Thereby, the Al alloy wire according to the above aspect has a higher elongation. Moreover, Zr has an effect of improving the high-temperature characteristics even at a minute amount, thereby, the Al alloy wire according to the above aspect is also superior in the high-temperature strength and the heat resistance.

Given as an aspect of the present invention, the Al alloy wire contains Mn at 0.01 mass % or more.

After investigations, the inventors of the present invention found that Mn has a great elongation improvement effect even at a minute amount. Thereby, the Al alloy wire according to the above aspect has a higher elongation. Moreover, Mn has an effect of improving the high-temperature characteristics even at a minute amount, thereby, the Al alloy wire according to the above aspect is superior in the high-temperature strength and the heat resistance.

Given as an aspect of the present invention, the tensile strength of the Al alloy wire after being retained for 1000 hours at an arbitrary temperature selected from a temperature range of 80° C. to 150° C. is 150 MPa or more.

Since the Al alloy wire according to the above aspect is capable of maintaining a high strength and superior in the heat resistance even in an environment exposed to a high temperature for a long time, it can be preferably used as a conductor material of an electrical wire to be disposed in a high-temperature location.

Given as an aspect of the present invention, the tensile strength of the Al alloy wire at an arbitrary temperature selected from a temperature range of 80° C. to 150° C. is 150 MPa or more.

Since the Al alloy wire according to the above aspect has a high strength even at a high temperature, it can be preferably used as a conductor material of an electrical wire to be disposed in a potential high-temperature location.

Given as an aspect of the present invention, the Al alloy wire further contains at least one element of Ti and B, and a content of Ti is 0.08% or less in mass % and a content of B is 0.016% or less in mass %.

Ti and B are elements having a structural refinement effect. Thereby, in addition to the elements of Zr, Mn and the like, the addition of Ti and B to the Al alloy wire of the present invention further increases the structural refinement effect, which thereby offers the Al alloy wire of the present invention a higher elongation.

The Al alloy wire of the present invention can be used as a single wire or as a strand of twisted wires. For example, as an Al alloy twisted wire of the present invention, the one twisted from a plurality of the Al alloy wires of the present invention mentioned in the above can be given.

Since the Al alloy wire of the present invention constituting the strand substantially maintains the structure (the structure of small maximum grain size) and the properties (the tensile strength, the electrical conductivity, the elongation and the high-temperature characteristics), the Al alloy twisted wire of the present invention has a high strength and a high electrical conductivity and is superior in elongation, high-temperature strength and heat resistance. In addition, compared to a single wire, by twisting together a plurality of the Al alloy wires of the present invention, it is possible to further improve mechanical characteristics such as the impact resistance and the flexing characteristics of the twisted wire as a whole.

The Al alloy wire and the Al alloy twisted wire of the present invention mentioned in the above can be preferably used as a conductor material of an electrical wire. For example, a covered electrical wire including a conductor which is any of the aluminum alloy wire of the present invention, the aluminum alloy twisted wire obtained by twisting together a plurality of the aluminum alloy wires of the present invention and a compression wire obtained by compression molding the aluminum alloy twisted wire of the present invention, and an insulation covering layer which covers an outer periphery of the conductor may be given as an example of the covered electrical wire of the present invention.

By including in the conductor the Al alloy wire or the Al alloy twisted wire of the present invention which has a high strength and a high electrical conductivity and is superior in elongation as mentioned in the above or the compression wire molded from the twisted wire, the covered electrical wire of the above aspect will have a high strength and a high electrical conductivity and will be superior in the elongation, the impact resistance and the flexing characteristics. Moreover, as mentioned in the above, since the Al alloy wire or the like of the present invention is superior in the high-temperature strength and the heat resistance, the covered electrical wire according to the above aspect is also superior in the high-temperature strength and the heat resistance.

The covered electrical wire of the present invention mentioned in the above can be preferably used as an electrical wire of a wire harness. For example, a wire harness including the covered electrical wire of the present invention mentioned in the above and a terminal section installed at an end portion of the covered electrical wire may be given as an example of the wire harness of the present invention.

By including the covered electrical wire of the present invention which has a high strength, a high electrical conductivity and a high toughness, the wire harness of the above aspect will have a high strength and a high electrical conductivity and will be superior in the elongation, the impact resistance and the flexing characteristics. Moreover, the wire harness according to the above aspect is also superior in the high-temperature strength and the heat resistance.

Advantageous Effects of Invention

The Al alloy wire of the present invention, the Al alloy twisted wire of the present invention, the covered electrical wire of the present invention and the wire harness of the present invention have a high strength, a high electrical conductivity and a superior elongation.

BRIEF DESCRIPTION OF DRAWINGS

FIG. 1(A) is a microphotograph of sample No. 1, FIG. 1(B) is a microphotograph of sample No. 11, FIG. 1(C) is a microphotograph of sample No. 16, and FIG. 1(D) is a microphotograph of sample No. 102.

DESCRIPTION OF EMBODIMENTS

Hereinafter, the present invention will be described in detail. The content of an element is expressed in mass %.

[Al Alloy Wire]

<Composition>

An Al alloy constituting an Al alloy wire of the present invention is an Al—Mg—Si alloy containing Mg at 0.03% to 1.5% and Si at 0.02% to 2.0% as essential elements, and includes at least one element selected from Cu, Fe, Cr, Mn and Zr as a crystal refinement element. Since Mg and Si are present in Al through solid solution or precipitation, the Al alloy wire of the present invention is superior in strength. Due to the fact that higher contents of Mg and Si will improve the strength of the Al alloy wire but will decrease electrical conductivity and toughness such as elongation and will make the Al alloy wire easy to break in an elongation treatment, the contents of Mg and Si are set at 1.5% or less and 2.0% or less, respectively.

Mg is an element having a high effect of improving strength, and in particular, if it is included together with Si in a specific range, it is expected to effectively improve the strength due to age hardening. It is preferable that the content of Mg is 0.2% to 1.5% and the content of Si is 0.1% to 1.5%, and more preferable that the content of Mg is 0.3% to 0.9% and the content of Si is 0.3% to 0.8%.

By containing a total of 0.1% or more of at least one element selected from Cu, Fe, Cr, Mn and Zr, it is possible to obtain an extra fine wire which has a structure of a maximum grain size of 50 μm or less and is superior in elongation. Higher total content of the above element tends to make it easy to refine the crystal grains and offer a greater elongation improvement effect; however, if the total content thereof is excessive, the electrical conductivity will be reduced. Thereby, the total content of the above element is set at 1.0% or less.

Among Cu, Fe, Cr, Mn and Zr, especially Zr and Mn have a greater refinement effect and elongation improvement effect, and are capable of improving elongation even at a minute amount of 0.01%. Therefore, as preferred aspects of the Al alloy wire of the present invention, an aspect containing Zr at 0.01% or more, an aspect containing Mn at 0.01% or more, and an aspect containing Zr and Mn each at 0.1% or more will be given. As to be described hereinafter, when Zr and Mn are contained, it is possible to sufficiently refine the crystal structure of a material (continuous casting-directed rolling material) obtained through continuous casting-directed rolling, and after the continuous casting-directed rolling, even through the material is subjected to a heat history resulted from an intermediate heat treatment, a solution treatment, an aging treatment and the like in manufacturing steps until being treated to a final wire diameter, it is difficult for the crystal grains to grow and thereby it is easy to maintain the crystal grains at a fine state. Consequently, it is easy to obtain the extra fine wire having a structure of small maximum grain size. It is expected that more contents of Zr and Mn can not only increase the elongation improvement effect due to the refinement but also improve the strength. As to be described hereinafter in an example, it is found that when Zr and Mn are contained, the extra fine wire has a high strength even at a high temperature of 80° C. or more and can maintain the high strength even after being retained at a high temperature of 80° C. or more for a long time. In other words, it is found that the extra fine wire has a strength not only in the heat history during the fabrication but also in the heat history during using. Therefore, it is preferable that at least one element of Zr and Mn is contained for the usage desired to be superior in high-temperature characteristics such as a high-temperature strength, a heat resistance and the like in addition to a high strength, a high electrical conductivity and a high toughness. In particular, when Zr is contained, it is more preferable that the content thereof is 0.02% to 0.40% so as to cope with such problems as preventing the electrical conductivity from decreasing and the cracking or the like from happening during casting due to the increased content of Zr. In particular, when Mn is contained, it is more preferable that the content thereof is 0.05% to 0.40% so as to cope with such problems as preventing the electrical conductivity from decreasing, the breaking from happening in the elongation and a slag from occurring in the solution or the like due to the increased content of Mn.

For each of Cu, Fe, Cr, there is a trend that the more the content is, the greater the elongation improvement effect resulted from the elongation will be; thereby, it is preferable that the content per element is 0.05% or more. In addition, Cu, Fe and Cr are effective in improving the strength. It is more preferable that the content of each element is Cu at 0.05% to 0.40%, Fe at 0.1% to 0.6% and Cr at 0.05% to 0.40% so as to cope with such problems as preventing the electrical conductivity from decreasing, the breaking form happening in the elongation and the slag from occurring in the solution or the like due to the increased contents of the above elements. Moreover, when Fe is contained within the above range, it is superior in the high-temperature strength and the heat resistance.

It is acceptable that only one element of Cu, Fe, Cr, Mn and Zr is contained; however, if plural elements are contained, it is expected that in addition to the refinement effect, it is possible to improve the strength as mentioned in the above. In particular, if one element (preferably Fe) of Cu, Fe and Cr and at least one element of Mn and Zr are contained, the Al alloy wire is superior in the high-temperature strength and the heat resistance.

Additionally, since Ti and B have the effect of refining the crystal structure in casting the Al alloy, it is preferable that at least one element of Ti and B is contained. By containing at least one element of Ti and B in addition to the elements such as Zr, Mn and the like having the refinement effect, it is possible for the crystal grains in the obtained material (preferably the continuous-casting material or the continuous casting-directed rolling material) to be extra fine after the casting and it is easy to maintain the crystal grains at the fine state in the manufacturing steps after the casting (easier to inhibit the growth of the crystal grains). Therefore, the composition which contains at least one element of Ti and B can result in an extra fine wire having a structure of small maximum grain size in the final wire diameter. It is acceptable to contain B only and the refinement effect can be obtained easily if Ti only is contained; however, the refinement effect will be further improved if both Ti and B are contained. If the content of at least one element of Ti and B is excessive, the electrical conductivity will be decreased; thereby, preferably Ti is 0.08% (800 ppm (mass fraction and the expression holds the same hereinafter)) or less and B is 0.016% (160 ppm) or less, and in order to obtain sufficient refinement effect, it is preferable that Ti is 0.005% (50 ppm) or more and B is 0.0005% (5 ppm) or more.

<Structure>

The Al alloy having the specific composition as mentioned in the above is mainly characterized by having a maximum grain size of 50 μm or less. It is considered that the smaller the maximum grain size is, the easier for the entire alloy structure to become extra fine and the more difficult for the coarse grains resulting in breaking to occur, and thereby the Al alloy is superior in elongation. Moreover, for the Al alloy having the specific composition as mentioned in the above, even though it is exposed to a high temperature for a long time, it is easy to maintain the crystal grains thereof at the fine state and it is difficult for the coarse grains resulting in breaking to occur, in other words, it is possible to maintain the structure having the maximum grain size of 50 μm or less; thereby it is superior in the heat resistance. Therefore, though the lower limit of the maximum grain size is not defined specifically, it is preferable that a ratio of the maximum grain size relative to the wire diameter is less than 10%. Depending on compositions and manufacturing conditions, the maximum grain size may be set at 40 μm or less as an aspect, or even 30 μm or less as another aspect. By controlling the crystal grains to such an extent satisfying a range that the maximum grain size is 50 μm or less, the grain boundary sliding which is dominant in high-temperature deformation is inhibited; thereby, the Al alloy having the specific composition as mentioned in the above is superior in the high-temperature strength. For example, when the structure has a maximum grain size from approximately 25 μm to 40 μm, the Al alloy having the specific composition tends to be superior in the high-temperature strength and the heat resistance. The measuring method of the maximum grain size will be described later.

<Room Temperature Characteristics>

The Al alloy wire of the present invention fabricated from the Al alloy having the specific composition and structure as mentioned in the above has not only a high strength but also a high electrical conductivity, satisfying such conditions that the tensile strength (room temperature) is 150 MPa or more and the electrical conductivity (room temperature) is 40% IACS or more. The tensile strength and the electrical conductivity can be varied in accordance with types and contents of additive elements and manufacturing conditions (elongation degree, temperatures or the like in a heat treatment (for example, aging treatment)). For example, if an additive element is added at a greater content and/or the elongation degree is increased (the wire diameter is made thinner), the tensile strength tends to become greater and the electrical conductivity tends to become smaller. Moreover, in performing the aging treatment, if the aging temperature is set lower, it is possible to obtain the Al alloy wire as an aspect having a high strength satisfying such conditions that the tensile strength (room temperature) is 240 MPa or more and the electrical conductivity (room temperature) is 45% IACS or more, and if the aging temperature is set higher, it is possible to obtain the Al alloy wire as another aspect having a high electrical conductivity satisfying such conditions that the tensile strength (room temperature) is 200 MPa or more and the electrical conductivity (room temperature) is 50% IACS or more. Although greater tensile strength and greater electrical conductivity are preferred, taken into consideration the balance between the toughness such as elongation and the strength, the upper limit of the tensile strength is about 400 MPa, and taken into consideration the increment limit of the electrical conductivity due to the aging precipitation of additive elements, the upper limit of the electrical conductivity is about 60% IACS.

Moreover, since the Al alloy wire of the present invention is fabricated from the Al alloy which contains at least one element selected from the specific elements of Cu, Fe, Cr, Mn and Zr within the specific range and has the specific structure having the maximum grain size of 50 μm or less, the Al alloy wire of the present invention is superior in elongation and the elongation (room temperature) thereof is 5% or more. Greater elongation enables superior impact resistance and flexing characteristics; thereby the upper limit of elongation is not restricted in particular. As to be described hereinafter, if the solution treatment only is performed without performing the aging treatment, the elongation can be as high as 10% or more; and if the aging treatment is performed, though the elongation tends to decrease, by containing at least one element selected from Cu, Fe, Cr, Mn and Zr within the specific range, it is still possible to make the elongation equal to 5% or more.

<High-Temperature Characteristics>

The Al alloy wire of the present invention fabricated from the Al alloy having the specific composition and structure as mentioned in the above can be superior not only in mechanical characteristics at room temperature but also in the strength at a high temperature according to an aspect. Specifically, for example, as an aspect, the Al alloy wire may have a tensile strength of 150 MPa or more at an arbitrary temperature (for example, 80° C., 85° C., 100° C., 120° C., 125° C., 150° C. or the like) selected from a temperature range of 80° C. to 150° C. (hereinafter, such tensile strength is referred to as "high-temperature strength"). Depending on the compositions, the high-temperature strength may be 160 MPa or more, preferably 180 MPa or more, and more preferably 190 MPa or more. Typically, the high-temperature strength increases as the temperature gets closer to 80° C. in the above temperature range, and the high-temperature strength tends to decrease as the temperature gets closer to 150° C.; however, the high-temperature strength can still be as high as 150 MPa or more as mentioned in the above. For example, an Al alloy wire according to an aspect has the tensile strength of 220 MPa or more at 80° C., an Al alloy wire according to an aspect has the tensile strength of 215 MPa or more at 100° C., an Al alloy wire according to an aspect has the tensile strength of 210 MPa or more at 120° C. and an Al alloy wire according to another aspect has the tensile strength of 195 MPa or more at 150° C. It is expected that the Al alloy wire according to each aspect can be preferably used in such a situation that the operating temperature thereof may become equal to the arbitrary temperature selected from the temperature range of 80° C. to 150° C. The Al alloy wire superior in the high-temperature strength according to an aspect may be fabricated from an Al alloy containing at least one element selected from Mn and Zr at 0.01% or more, or from an Al alloy containing Fe at 0.1% or more.

The Al alloy wire of the present invention fabricated from the Al alloy having the specific composition and structure as mentioned in the above can be superior not only in mechanical characteristics at room temperature but also in the strength after being retained for a long time at a high temperature according to an aspect. Specifically, for example, as an aspect, the Al alloy wire may have a tensile strength of 150 MPa or more after being retained for 1000 hours at an arbitrary temperature (for example, 80° C., 85° C., 100° C., 120° C., 125° C., 150° C. or the like) selected from a temperature range of 80° C. to 150° C. (hereinafter, such tensile strength is referred to as "high-temperature retention strength"). Depending on the compositions, the high-temperature retention strength may be 180 MPa or more, preferably 190 MPa or more, more preferably 200 MPa or more, further preferably 220 MPa or more, and particularly preferably 240 MPa or more. Additionally, depending on the compositions, the high-temperature retention strength of an aspect may be equal to or greater than the tensile strength at room temperature. Typically, the high-temperature retention strength tends to increase as the temperature gets closer to 80° C. in the above temperature range, and the high-temperature retention strength tends to decrease as the temperature gets closer to 150° C.; however, the high-temperature retention strength can still be as high as 150 MPa or more as mentioned in the above. For example, an aspect of an Al alloy wire having a high-temperature retention strength of 250 MPa after being retained for 1000 hours at 80° C., an aspect of an Al alloy wire having a high-temperature retention strength of 245 MPa or more after being retained for 1000 hours at 100° C., an aspect of an Al alloy wire having a high-temperature retention strength of 240 MPa or more after being retained for 1000 hours at 120° C. and an aspect of an Al alloy wire having a high-temperature retention strength of 200 MPa or more after being retained for 1000 hours at 150° C. may be given as examples. It is expected that the Al alloy wire according to each aspect can be preferably used in such a situation that the operating temperature thereof may become equal to the arbitrary temperature selected from the temperature range of 80° C. to 150° C. Improved strength is desired in practical using. According to an aspect, the Al alloy wire superior in the high-temperature retained strength may be fabricated from an Al alloy containing at least one element selected from Mn and Zr at 0.01% or more, or from an Al alloy containing Fe at 0.1% or more.

<Wire Diameter>

The Al alloy wire of the present invention is an extra fine wire having a wire diameter of 0.5 mm or less. By appropriately adjusting the elongation degree (reduction ratio of section area) in performing the elongation treatment, it is possible to vary the wire diameter. For example, when the Al alloy wire of the present invention is used as a conductor for an electrical wire of a vehicular wire harness, the wire diameter may be 0.1 mm-0.4 mm.

<Section Shape>

The Al alloy wire of the present invention may be processed to have various section shapes according to die shapes in the elongation treatment. A round wire having a circular section shape is typical. In addition, the section shape may be any of various shapes such as an elliptical shape, a polyangular shape such as a rectangular shape, a hexagonal shape, and the like. When the section shape is the elliptical shape or an irregular shape such as the hexagonal shape or the like, the wire diameter is defined as a maximum length across the section area (the major axis in the case of an ellipse, the diagonal line in the case of a rectangle or a hexagon).

[Al Alloy Twisted Wire]

Twisting a plurality of the Al alloy wires of the present invention, each being an extra fine wire, into a twisted wire ("Al alloy twisted wire" of the present invention) offers a conductor which is further superior in the impact resistance and the flexing characteristics. The number of the Al alloy wires to be twisted into the Al alloy twisted wire of the present invention is not limited particularly. For example, the exemplified number of the Al alloy wires to be twisted are 7, 11, 19, 37, 49 and 133. If the Al alloy twisted wire of the present invention is formed into a compression wire through compression molding, the wire diameter thereof can be reduced smaller than that in the twisted state, which contributes to reducing the conductor diameter.

[Covered Electrical Wire]

The Al alloy wire of the present invention, the Al alloy twisted wire of the present invention and the compression wire mentioned in the above may be directly used as the conductor of an electrical wire, and if an insulation covering layer is provided on an outer periphery of the conductor, each can be used as a covered electrical wire of the present invention. As an insulating material constituting the insulation covering layer, any material superior in flame resistance, for example polyvinyl chloride (PVC) or non-halogen resin, may be given. The thickness of the insulation covering layer can be selected appropriately according to desired insulation strength, thereby it is not limited in particular.

[Wire Harness]

The covered electrical wire of the present invention may be preferably used as a constituent member of a wire harness of the present invention. Typically, the wire harness of the present invention is provided with a plurality of electrical wires including at least one covered electrical wire of the present invention and a terminal section installed at an end portion of each electrical wire. Each electrical wire is connected to a subject such as an electrical device or the like through the terminal section. In addition to the aspect of the wire harness of the present invention in which one terminal section is connected respectively to each of the electrical wires, another aspect in which a plurality of the electrical wires is connected collectively to one terminal section as a group of electrical wires is also acceptable. The type of the terminal section may be any of various types such as a male type, a female type, a crimp type, a welded type and the like and is not limited particularly. Bundling the plurality of electrical wires included in the wire harness together by using a bundling member or the like provides superior handling ability.

[Fabrication Method]

Typically, the Al alloy wire of the present invention can be fabricated according to the following fabrication method. The fabrication method for fabricating an aluminum alloy wire to be used as a conductor includes a continuous casting-directed rolling step, an elongation step and a solution step, which will be described hereinafter.

In the continuous casting-directed rolling step, the molten Al alloy containing in mass % Mg at 0.03% to 1.5%, Si at 0.02% to 2.0%, at least one element selected from Cu, Fe, Cr, Mn and Zr at a total of 0.1% to 1.0%, and the balance being Al is casted continuously and thereafter rolled continuously to offer a continuous casting-directed rolling material.

In the elongation step, an elongation treatment is performed on the continuous casting-directed rolling material to offer an elongated wire material having a wire diameter of 0.5 mm or less.

In the solution step, a solution treatment is performed on the elongated wire material to offer a solid solution wire material.

Specifically, in the solution treatment, the heating temperature is set at 450° C. or more, and in a cooling step after the heating, the cooling speed is set at 100° C./min or more.

It is acceptable for the above fabrication method to include a step (aging step) in which an aging treatment is performed on the solid solution wire material to offer an aging wire material. In the aging treatment, the heating temperature is set at 100° C.-300° C., and the retention time is set at 4 hours or more.

It is acceptable for the above fabrication method to include a step (homogenization step) in which a homogenization treatment is performed on the continuous casting-directed rolling material to offer a homogenization material and the elongation treatment is performed on the homogenization material. In the homogenization treatment, the heating temperature is set at 450° C. or more and the retention time is set at 1 hour or more, and in a cooling step after the heating, the cooling speed is set at 1° C./min or less (slow cooling).

<Continuous Casting-Directed Rolling Step>

The inventors of the present invention found that in order to fabricate an Al alloy wire which is extra fine and has a crystal structure of small maximum grain size, it is also preferable to fabricate the Al alloy wire having the fine crystal structure at an upstream step in the fabrication process. Thereby, the application of continuous casting-directed rolling is proposed in manufacturing the Al alloy wire of the present invention. In the continuous casting, since the molten alloy can be solidified through rapid solidification, it is possible to obtain a casting material having a fine crystal structure. The cooling speed in the casting may be selected appropriately; however, it is preferable that the cooling speed is set at 5° C./sec or more in a solid-liquid coexistence temperature range of 600° C. to 700° C. For example, the rapid solidification at the above cooling speed may be accomplished easily by using a continuous casting apparatus equipped with a water-cooled copper mold, a forcible water cooling mechanism or the like. The continuous casting may be any aspect using a mobile mold of a belt-and-wheel type or the like or using a immobile frame mold.

On the casting material obtained from the continuous casting, the directed rolling is performed consecutively after the casting. Accordingly, it is easy to perform the hot rolling by using the heat accumulated in the casting material so as to improve the energy efficiency; and in addition by performing the directed rolling immediately on the casting material having a fine crystal structure, it is possible to offer the directed rolling material (continuous casting-directed rolling material) a fine crystal structure.

If Ti and B are added, it is preferable that Ti and B are added immediately before the molten alloy is injected to the mold; thereby, the local deposition of Ti and the like is inhibited, which enables the fabrication of a casting material wherein Ti and the like are homogeneously mixed.

<Homogenization Step>

The inventors of the present invention found that it is possible to obtain the Al alloy wire which has the structure of small maximum grain size and is superior in elongation by performing appropriately the solution treatment and further the aging treatment after the elongation, and it is relatively easy to obtain the Al alloy superior in elongation if a homogenization treatment is performed preliminarily on the material (continuous casting-directed rolling material) before the elongation. The reason for this has been considered that homogeneous and fine dispersion of a coarse compound (typically a compound of Mg and Si) formed in the casting enables the elements to be dissolved sufficiently and homogeneously in the solution step after the elongation. By adding at least one element selected from Cu, Fe, Cr, Mn and Zr, which are elements having the refinement effect, it is possible to inhibit grains from becoming coarse in the homogenization treatment, and it is also possible to prevent the growth of grains in the intermediate heat treatment in the elongation step to be described hereinafter, and in the solution treatment and the aging treatment after the elongation to maintain the structure at the small maximum grain size.

In the above homogenization treatment, by setting the heating temperature at 450° C. or more and the retention time at 1 hour or more, it is possible to homogeneously and finely disperse the compound of Mg and Si formed in the casting so as to homogenize the composition. Preferably, the heating temperature is 500° C.-600° C. and the retention time is 3-10 hours. If the cooling is performed slowly (cooling speed at 1° C./min or less) after the heating, the compound of Mg and Si mentioned in the above can be dispersed further homogeneously and finely. The above cooling speed may be accomplished according to a cooling approach, i.e., furnace cooling in which a heating furnace (for example, a box-type heating furnace) which is used to perform the homogenization treatment is cooled down naturally after the heating. By adjusting the temperature inside the furnace through heating appropriately the atmosphere inside the furnace or introducing cooling gas or the like into the furnace in accordance with the dimension of the heating furnace, it is possible to adjust the cooling speed.

In the present invention, by containing the elements such as Zr, Mn and the like having the refinement effect at specific ranges, it is possible to maintain the fine state even after the homogenization treatment.

<Elongation Step>

The (cold) elongation treatment is performed on the continuous casting-directed rolling material or the homogeneous material. The elongation degree may be selected appropriately in accordance with a desired wire diameter. By containing the elements such as Zr, Mn and the like having the refinement effect at specific ranges, it is possible to inhibit the breaking in the elongation so as to offer the elongated wire material continuously with a long length; thereby, it is superior in the manufacturability of the elongated wire material.

An appropriate intermediate heat treatment during the elongation treatment helps to remove distorsions occurred in the treatments prior to the intermediate heat treatment, improving the workability of the elongation treatment on the wire material after the intermediate heat treatment. As conditions of the intermediate heat treatment, for example, the heating temperature may be 250° C.-450° C. and the heating time may be 0.5 hours or more. The conditions of the intermediate heat treatment may be identical to those of the solution treatment to be described hereinafter. In the present invention, by containing the elements such as Zr, Mn and the like having the refinement effect at specific ranges, it is possible to maintain the fine state even after the intermediate heat treatment.

<Solution Step>

In the case where the elongated wire material having the above final wire diameter is formed into the twisted wire or in the case where the elongated wire material before being twisted or the twisted wire after being twisted is formed into the compression wire, the solution treatment is performed on the elongated wire material before being twisted, the twisted wire before being compressed or the compression wire after being compressed. The solution treatment is mainly aimed at dissolving Mg and Si. In the case where the aging treatment is to be performed as a subsequent step, the performance of the solution treatment helps to disperse finely the compound of Mg and Si, which contributes to the strength, between crystal grains in the aging treatment. Moreover, since at least one element selected from Cu, Fe, Cr, Mn and Zr also undergoes the solid solution in the solution treatment, it is expected to improve the strength.

In the solution treatment, the heating temperature is set at 450° C. or more so as to dissolve Mg and Si completely, and after the heating the wire material is cooled rapidly to prevent excess precipitation of the dissolved elements. Specifically, the cooling speed is set at 100° C./min or more. Faster cooling speed is preferable, and more preferably the cooling speed is set at 200° C./min or more. The above cooling speed can be accomplished through forcible cooling such as immersing the wire material in a cool liquid medium such as water, liquid nitrogen or the like or blowing the wire material with wind. The heating temperature is set at 500° C.-620° C. and preferably at 600° C. or less, and the retention time is set at 0.005 seconds to 5 hours and preferably at 0.01 seconds to 3 hours. In case that the above homogenization treatment is performed, each additive element can be sufficiently dissolved even though the retention time of the solution treatment is shortened. A continuous processing approach, which will be described hereinafter, may be preferably used in the solution treatment having such short retention time.

As an atmosphere in the solution treatment, typically, air atmosphere may be given. In addition, if an atmosphere containing less oxygen, for example, a non-oxidizing atmosphere is used, it is possible to prevent an oxide film from being generated on the surface of the subject wire material due to the heat in the solution treatment. The non-oxidizing atmosphere, for example, may be a vacuum atmosphere (depressurized atmosphere), an inert gas atmosphere and a reduction gas atmosphere. The inert gas atmosphere may include nitrogen ($N_2$) and argon (Ar). The reduction gas atmosphere may include hydrogen containing gas (for example, pure hydrogen ($H_2$), and a mixture gas of an inert gas such as $N_2$, Ar or helium (He) and hydrogen ($H_2$)) and carbon-rich gas (for example, a mixture gas of carbon monoxide (CO) and carbon dioxide ($CO_2$)).

Any of the continuous processing approach and a batch processing approach to be described hereinafter can be used in the solution treatment. Application of the continuous processing approach to the solution treatment helps to easily perform the heat treatment homogeneously over the entire length of the long wire material so as to reduce variations in the characteristics and to continuously perform the heat treatment on the extra fine wire having the final wire diameter of 0.5 mm or less, which improves the productivity; and thereby, it is preferred. The continuous processing approach is such an approach in which the heating subject (the elongated wire material, the twisted wire or the like as mentioned in the above) is continuously delivered into a heating container and heated therein continuously. As the continuous processing approach, for example, the followings may be given: a direct electrifying approach (ohmic heating) which heats the heating subject according to resistance heating, an indirect electrifying approach (high-frequency induction heating) which heats the heating subject according to high-frequency electromagnetic induction, and a furnace heating approach which introduces the heating subject into a heating container (pipe furnace), which serves as the heating atmosphere, to heat the heating subject according to heat conduction. The transportation speed of the wire material, the value of an electrical current, the temperature of the atmosphere and the like may be adjusted so as to heat the heating subject to a temperature of 450° C. or more.

According to the solution step, it is possible to obtain the Al alloy wire of the present invention which has the above specific composition, the wire diameter of 0.5 mm or less, the maximum grain size of 50 μm or less, the electrical conductivity (room temperature) of 40% IACS or more, the tensile strength (room temperature) of 150 MPa or more, and the elongation (room temperature) of 5% or more. By twisting the Al alloy wires together, the Al alloy twisted wire of the present invention is obtained. By compressing the twisted wire, the above compression wire is obtained. As mentioned in the above, it is acceptable to perform the twisting and/or the compression before the solution step.

<Aging Step>

Performing the aging treatment after the solution treatment helps to precipitate the additive elements such as Mg, Si, Zr and the like in the Al alloy and disperse the precipitates in the Al alloy. Thereby, it can be expected to improve the strength according to the reinforced dispersion, i.e., the age hardening of the precipitates, and meanwhile it can be expected to improve the electrical conductivity by reducing the amount of the dissolved elements. Accordingly, the Al alloy wire obtained after the aging step in the present invention has a higher strength and a higher electrical conductivity. Further, since the Al alloy wire of the present invention contains the elements having the refinement effect such as Zr, Mn and the like, the crystal grains maintain extra fine after the aging step; thereby, it is easy for the fine precipitates to be dispersed homogeneously in the structure containing the fine crystal grains. The fine structure also helps to further improve the strength, which enables the Al alloy wire to be superior in both the strength and the electrical conductivity. Furthermore, since the Al alloy wire of the present invention has the structure of small maximum grain size even after the aging step, thereby it is superior in elongation. In addition to the solution treatment, if the aging treatment is further performed, the high-temperature strength and the high-temperature retention strength tend to become higher.

The aging treatment can be performed under such a condition that the heating temperature is in a range of 100° C.-300° C. and the retention time is 4 hours or more so as to precipitate the precipitates sufficiently and homogeneously. If the heating temperature is set relatively low (180° C. or less) in the above range, it is tended to obtain an aspect of the Al alloy wire having a higher strength and a higher elongation (for example, the tensile strength of 240 MPa or more (may be 300 MPa or more depending on the composition and the temperature), the electrical conductivity of 45% IACS or more, and the elongation of 6% or more); and if the heating temperature is set relatively high (higher than 180° C.) in the above range, it is tended to obtain an aspect of the Al alloy wire having a higher electrical conductivity (for example, the tensile strength of 200 MPa or more, the electrical conductivity of 50% IACS or more, and the elongation of 5% or more). Thereby, the heating temperature may be selected in accordance with desired characteristics. It is preferable that the heating temperature is set at 140° C.-250° C. and the retention time is set at 4 hours to 16 hours. The longer the retention time in the aging treatment is, the more the precipitates may be precipitated; thereby, the longer retention time helps to improve the electrical conductivity. In addition, even though the aging treatment is not performed, if the environment of usage is at a high temperature to a certain extent (particularly 100° C. or more), the Al alloy wire may be subjected to an ex-post aging treatment by the temperature of the environment of usage, which helps to improve the strength.

Similar to the homogenization treatment mentioned in the above, it is possible for the cooling step to use the furnace cooling, the cooling in air atmosphere and the like in the aging treatment.

The above continuous processing approach can be used in the above aging treatment; however, if the batch processing approach is used, it is possible to provide a sufficient heat treatment time so as to precipitate the precipitates sufficiently. The batch processing approach is such an approach that the heating subject is enclosed in a heating container (atmosphere furnace such as a box-type furnace) and heated therein. The atmosphere temperature may be adjusted so as to make the heating temperature equal to the temperature mentioned in the above. The atmosphere of the aging treatment may be air atmosphere or the atmosphere containing less oxygen as described above.

With the aging step, the present invention provides the Al alloy wire which has the above specific composition, the wire diameter of 0.5 mm or less, the maximum grain size of 50 μm or less, the electrical conductivity (room temperature) of 40% IACS or more, the tensile strength (room temperature) of 150 MPa or more, and the elongation (room temperature) of 5% or more. As mentioned in the above, the Al alloy wire may be twisted into the twisted wire or compressed into the compression wire. It is acceptable to perform the twisting and/or the compression before the aging step.

<Covering Step>

The solid solution wire material or the aged wire material (any of the single wire, the twisted wire and the compression wire) on which the solution treatment and an appropriate aging treatment have been performed is prepared, and thereafter, by performing a step in which the insulation covering layer fabricated from the above insulating material is formed on the periphery of the above wire material, it is possible to obtain the covered electrical wire of the present invention.

<Installation Step of Terminals>

Installation of a terminal section to an end portion of the obtained covered electrical wire, and typically bundling a plurality of the covered electrical wires installed with the terminal section provides the wire harness of the present invention.

Example 1

The Al alloy wire was prepared and various characteristics of the Al alloy wire were investigated. The Al alloy wire was prepared in the order of the melting step, the continuous casting-directed rolling step, the homogenization step, the elongation step (appropriate intermediate heat treatment), the solid solution step and the aging step.

Pure aluminum (containing Al at 99.7 mass % or more) was prepared and melted as the base, and the additive elements listed in Table 1 were added in such a way that the contents thereof in the obtained molten solution (molten aluminum) match the contents (mass %) listed in Table 1 to prepare the molten Al alloy (containing additive elements and the balance of Al). It is preferable to perform appropriately a hydrogen degassing treatment and/or a foreign matter removing treatment on the molten Al alloy after the components thereof were adjusted.

TABLE 1

| Sample No. | Si | Mg | Fe | Cu | Mn | Cr | Zr | Fe, Cu, Mn, Cr, Zr Sum | Ti | B |
|---|---|---|---|---|---|---|---|---|---|---|
| 1 | 0.64 | 0.88 | 0.30 | 0.18 | — | 0.14 | — | 0.62 | 0.06 | 0.012 |
| 2 | 0.64 | 0.88 | 0.13 | — | 0.20 | — | — | 0.33 | 0.02 | 0.004 |
| 3 | 0.64 | 0.88 | 0.13 | — | 0.10 | — | — | 0.23 | 0.02 | 0.004 |
| 4 | 0.64 | 0.88 | 0.13 | — | 0.05 | — | — | 0.18 | 0.02 | 0.004 |
| 5 | 0.64 | 0.88 | 0.13 | — | — | 0.20 | — | 0.33 | 0.02 | 0.004 |
| 6 | 0.57 | 0.77 | 0.30 | 0.18 | — | 0.14 | — | 0.62 | 0.02 | 0.004 |
| 7 | 0.57 | 0.77 | 0.13 | — | 0.20 | — | — | 0.33 | 0.02 | 0.004 |
| 8 | 0.57 | 0.77 | 0.13 | — | — | 0.20 | — | 0.33 | 0.02 | 0.004 |
| 9 | 0.52 | 0.67 | 0.30 | 0.18 | — | 0.14 | — | 0.62 | 0.02 | 0.004 |
| 10 | 0.52 | 0.67 | 0.13 | — | — | 0.20 | — | 0.33 | 0.02 | 0.004 |
| 11 | 0.52 | 0.67 | 0.13 | — | — | — | 0.15 | 0.28 | 0.02 | 0.004 |
| 12 | 0.52 | 0.67 | 0.13 | — | — | — | 0.10 | 0.23 | 0.02 | 0.004 |
| 13 | 0.52 | 0.67 | 0.13 | — | — | — | 0.05 | 0.18 | 0.02 | 0.004 |
| 14 | 0.52 | 0.67 | 0.40 | — | — | — | — | 0.4 | 0.02 | 0.004 |
| 15 | 0.52 | 0.67 | 0.13 | 0.20 | — | — | — | 0.33 | 0.02 | 0.004 |
| 16 | 0.52 | 0.67 | 0.13 | — | 0.20 | — | 0.15 | 0.48 | 0.02 | 0.004 |

TABLE 1-continued

| Sample No. | Si | Mg | Fe | Cu | Mn | Cr | Zr | Fe, Cu, Mn, Cr, Zr Sum | Ti | B |
|---|---|---|---|---|---|---|---|---|---|---|
| 17 | 0.52 | 0.67 | 0.40 | 0.20 | — | 0.20 | — | 0.8 | 0.02 | 0.004 |
| 18 | 0.52 | 0.67 | 0.40 | 0.20 | 0.20 | — | — | 0.8 | 0.02 | 0.004 |
| 19 | 0.52 | 0.67 | 0.40 | 0.20 | 0.20 | — | 0.15 | 0.95 | 0.02 | 0.004 |
| 20 | 0.52 | 0.67 | 0.40 | 0.20 | — | — | 0.15 | 0.75 | 0.02 | 0.004 |
| 21 | 0.52 | 0.67 | 0.13 | — | 0.20 | — | — | 0.33 | 0.02 | 0.004 |
| 22 | 0.42 | 0.51 | 0.13 | — | 0.20 | — | — | 0.33 | 0.02 | 0.004 |
| 23 | 0.32 | 0.34 | 0.30 | 0.18 | — | 0.14 | — | 0.62 | 0.02 | 0.004 |
| 101 | 0.64 | 0.88 | — | — | — | — | — | — | 0.02 | 0.004 |
| 102 | 0.52 | 0.67 | — | — | — | — | — | — | — | — |

A continuous casting-directed rolling apparatus of a belt-and-wheel type was used to perform the continuous casting-directed rolling, that is, to perform the casting and the hot rolling continuously on the prepared molten Al alloy to prepare a wire rod (continuous casting-directed rolling material) of ϕ9.5 mm. A TiB wire was supplied to the molten Al alloy immediately before the casting in such a way that the samples containing Ti and B have the contents (mass %) listed in Table 1.

A homogenization treatment was performed on the wire rod. The homogenization treatment was performed by using a box-type furnace at the heating temperature of 530° C. with the retention time of 5 hours, and the cooling after the heating was performed through the furnace cooling. The cooling speed in the cooling step was 0.89° C./min (1° C./min or less).

A cold elongation treatment was performed on the homogeneous material after the homogenization treatment to prepare an elongated wire material having the final wire diameter of ϕ0.3 mm. An intermediate heat treatment (at 300° C. for 3 hours) was performed appropriately during the process of the elongation treatment.

A solution treatment was performed on the obtained elongated wire material having the final wire diameter of ϕ0.3 mm to prepare a molten wire material. The solution treatment was performed in a box-typed furnace at the heating temperature of 530° C. for a retention time of 3 hours. After the heating, the material was cooled rapidly. The rapid cooling was performed by dipping the material in a water tank, and the cooling speed in the cooling step was 675° C./min (100° C./min or more).

For the obtained molten wire material (Al alloy wire), the tensile strength (MPa), the elongation (%) and the electrical conductivity (% IACS) were examined at room temperature (RT, 25° C.). The results are shown in Tables 2 to 4.

The tensile strength (MPa) and the elongation (%, breaking elongation) were measured by using a general tensile testing machine on the basis of JIS Z 2241 (Tensile testing method for metallic materials, 1998). The electrical conductivity (% IACS) was measured according to the bridge method.

The aging treatment was performed on the obtained solid solution wire material at various temperatures to prepare an aging wire material. The aging treatment was performed by using a box-typed furnace at temperatures listed in Tables 2 to 4 for a retention time of 8 hours for each temperature. After the heating, the wire material was cooled in air atmosphere.

For the obtained aging wire material (Al alloy wire), the tensile strength (MPa), the elongation (%) and the electrical conductivity (% IACS) were examined at room temperature (25° C.), similar to the above. The results are shown in Tables 2 to 4.

Thereafter, for samples No. 1, No. 11, No. 16 and No. 102 in the obtained aging wire material (Al alloy wire), the cross section of each sample was prepared and observed under an optical microscope. FIG. 1(A), FIG. 1(B), FIG. 1(C) and FIG. 1(D) are microphotographs of sample No. 1 (3000 times), sample No. 11 (1000 times), sample No. 16 (3000 times) and sample No. 102 (250 times), respectively. The maximum grain size was examined on the basis of observed images of samples No. 1, No. 11, No. 16 and No. 102 under microscope. Specifically, on the basis of JIS G 0551 (Steels-Micrographic determination of the grain size, 2005), a test line was drawn in the observed image and the length sectioning the test line was determined as the grain size of each grain (method of section). 3 view fields were defined in 1 section area and 1 test line was drawn in each view field, and among the 3 view fields, the greatest grain size was determined as the maximum grain size. Similarly, the maximum grain size was determined for the other samples. The results are shown in Tables 2 to 4. The maximum grain size was measured on the wire materials subjected to an aging temperature of 160° C. or 180° C. The maximum grain size of sample No. 15 was measured after the wire material was subjected to the solution treatment.

TABLE 2

| Sample No. | Maximum grain size (μm) | Tensile Strength (MPa) Aging Temperature (° C.) 25 (RT) | 140 | 160 | 180 | 200 | 220 | 250 |
|---|---|---|---|---|---|---|---|---|
| 1 | 20 | 292 | 304 | 326 | 331 | 304 | — | — |
| 2 | 25 | 293 | 304 | 321 | 324 | 284 | — | — |
| 3 | 25 | — | — | 247 | — | — | — | — |
| 4 | 25 | — | — | 210 | — | — | — | — |
| 5 | 30 | 260 | 269 | 279 | 290 | 258 | — | — |
| 6 | 25 | 246 | — | 339 | 322 | 293 | 254 | 207 |
| 7 | 25 | 267 | — | 340 | 345 | 288 | 226 | 207 |
| 8 | 25 | 238 | — | 339 | 303 | 254 | 213 | 165 |
| 9 | 25 | 236 | — | 342 | 314 | — | 248 | 195 |
| 10 | 25 | 202 | — | 284 | 274 | 224 | 186 | 157 |
| 11 | 35 | 252 | — | 326 | — | — | 222 | 174 |
| 12 | 35 | — | — | — | 280 | 232 | — | — |
| 13 | 35 | — | — | 249 | 243 | — | — | — |
| 14 | 20 | — | — | 174 | — | — | — | — |
| 15 | 40 | 150 | — | — | — | — | — | — |
| 16 | 25 | 245 | — | 316 | — | — | 221 | 171 |
| 17 | 25 | 259 | — | 336 | 308 | — | 258 | 212 |
| 18 | 20 | 271 | — | 361 | — | — | 272 | 222 |
| 19 | 20 | 269 | — | 347 | — | 282 | 272 | 219 |
| 20 | 20 | 274 | — | 346 | — | — | 267 | 221 |
| 21 | 25 | 226 | — | 312 | 307 | 266 | 214 | 162 |
| 22 | 25 | 187 | — | 242 | — | — | — | 158 |
| 23 | 20 | 152 | — | 155 | — | — | — | — |
| 101 | 250 | — | — | — | 201 | — | — | — |
| 102 | 300 | — | — | — | — | 174 | — | — |

TABLE 3

| Sample No. | Maximum grain size (μm) | Elongation (%) Aging Temperature (° C.) 25 (RT) | 140 | 160 | 180 | 200 | 220 | 250 |
|---|---|---|---|---|---|---|---|---|
| 1 | 20 | 16 | 18 | 11 | 6 | 5 | — | — |
| 2 | 25 | 16 | 17 | 14 | 6 | 5 | — | — |
| 3 | 25 | — | — | 18 | — | — | — | — |
| 4 | 25 | — | — | 20 | — | — | — | — |
| 5 | 30 | 19 | 20 | 15 | 7 | 6 | — | — |
| 6 | 25 | 14 | — | 8 | 5 | 5 | 5 | 6 |
| 7 | 25 | 16 | — | 7 | 6 | 5 | 5 | 7 |
| 8 | 25 | 17 | — | 6 | 5 | 5 | 5 | 8 |
| 9 | 25 | 17 | — | 7 | 5 | — | 6 | 8 |
| 10 | 25 | 14 | — | 7 | 5 | 5 | 5 | 8 |
| 11 | 35 | 19 | — | 7 | — | — | 7 | 9 |
| 12 | 35 | — | — | — | 7 | 5 | — | — |
| 13 | 35 | — | — | 8 | 6 | — | — | — |
| 14 | 20 | — | — | 9 | — | — | — | — |
| 15 | 40 | 19 | — | — | — | — | — | — |
| 16 | 25 | 20 | — | 7 | — | — | 7 | 11 |
| 17 | 25 | 16 | — | 6 | 5 | — | 6 | 7 |
| 18 | 20 | 16 | — | 6 | — | — | 6 | 7 |
| 19 | 20 | 16 | — | 6 | — | 5 | 6 | 7 |
| 20 | 20 | 16 | — | 5 | — | — | 5 | 6 |
| 21 | 25 | 17 | — | 7 | 5 | 5 | 7 | 9 |
| 22 | 25 | 14 | — | 7 | — | — | — | 7 |
| 23 | 20 | 11 | — | 9 | — | — | — | — |
| 101 | 250 | — | — | — | 1 | — | — | — |
| 102 | 300 | — | — | — | — | 0.3 | — | — |

TABLE 4

| Sample No. | Maximum grain size (μm) | Electrical Conductivity (% IACS) Aging Temperature (° C.) 25 (RT) | 140 | 160 | 180 | 200 | 220 | 250 |
|---|---|---|---|---|---|---|---|---|
| 1 | 20 | 43 | 44 | 44 | 48 | 50 | — | — |
| 2 | 25 | 45 | 45 | 45 | 50 | 52 | — | — |
| 3 | 25 | — | — | 46 | — | — | — | — |
| 4 | 25 | — | — | 47 | — | — | — | — |
| 5 | 30 | 43 | 43 | 44 | 47 | 50 | — | — |
| 6 | 25 | 46 | — | 48 | 51 | 51 | 52 | 54 |
| 7 | 25 | 45 | — | 48 | 50 | 53 | 54 | 56 |
| 8 | 25 | 45 | — | 47 | 49 | 50 | 52 | 54 |
| 9 | 25 | 47 | — | 50 | 51 | — | 53 | 54 |
| 10 | 25 | 46 | — | 49 | 50 | 51 | 52 | 52 |
| 11 | 35 | 48 | — | 52 | — | — | 56 | 57 |
| 12 | 35 | — | — | — | 54 | 55 | — | — |
| 13 | 35 | — | — | 53 | 55 | — | — | — |
| 14 | 20 | — | — | 51 | — | — | — | — |
| 15 | 40 | 48 | — | — | — | — | — | — |
| 16 | 25 | 46 | — | 50 | — | — | 53 | 54 |
| 17 | 25 | 46 | — | 49 | 50 | — | 51 | 52 |
| 18 | 20 | 46 | — | 50 | — | — | 52 | 53 |
| 19 | 20 | 46 | — | 49 | — | 51 | 51 | 52 |
| 20 | 20 | 47 | — | 51 | — | — | 53 | 54 |
| 21 | 25 | 47 | — | 50 | 52 | 53 | 54 | 55 |
| 22 | 25 | 51 | — | 52 | — | — | — | 56 |
| 23 | 20 | 52 | — | 52 | — | — | — | — |
| 101 | 250 | — | — | — | 49 | — | — | — |
| 102 | 300 | — | — | — | — | 57 | — | — |

It is obvious that the maximum grain size of each sample among samples No. 1 to No. 23 containing specific elements of Cu, Fe, Cr, Mn and Zr is 50 μm or less, and as illustrated in FIGS. 1(A), 1(B) and 1(C), the grains are very fine and vary slightly in size. For example, for sample No. 1 illustrated in FIG. 1(A), each grain has a size of 2 μm to 20 μm and the maximum grain size is 20 μm, for sample No. 11 illustrated in FIG. 1(B), each grain has a size of 4 μm to 35 μm and the maximum grain size is 35 μm, and for sample No. 16 illustrated in FIG. 1(C), each grain has a size of 2 μm to 25 μm and the maximum grain size is 25 μm; it is obvious that the grains are very fine. Also, it is obvious that the very fine precipitates are homogeneously dispersed in the fine grains. Further, it is obvious that the elongation of each sample among samples No. 1 to No. 23 either after the solution treatment or after the aging treatment is 5% or more, superior in elongation. In particular, it is obvious that the elongation of sample No. 11 containing Zr and the elongation of sample No. 16 containing Zr and Mn after the aging treatment are 9% and 11%, respectively, greatly superior in elongation.

On the other hand, it is obvious that the maximum grain size of sample No. 102 containing none of Cu, Fe, Cr, Mn and Zr is 300 μm, and as illustrated in FIG. 1D, the grains are very coarse and vary greatly in size (the size of each grain is 50 μm to 300 μm). As illustrated in Table 3, it is obvious that the elongation of sample No. 102 after the aging treatment is very small (0.3%), without any elongation substantially.

Further, it is obvious that each sample among samples No. 1 to No. 23 either after the solution treatment or after the aging treatment have the tensile strength as high as 150 MPa or more and the electrical conductivity as high as 40% IACS or more. In particular, if the temperature in the aging treatment is relatively low (180° C. or less), it is found that the strength is improved due to the age hardening, and if the temperature is relatively high (higher than 180° C.), it is found that the electrical conductivity is improved due to the precipitation of the precipitates. On the other hand, sample No. 101 and sample No. 102 both containing none of Cu, Fe, Cr, Mn and Zr have the electrical conductivity comparable to sample No. 1 or the like but a weaker strength and a smaller elongation after the aging treatment.

It has been discovered from the examples that it is possible to improve the strength and the elongation and/or improve the electrical conductivity by adjusting the temperature in the aging treatment. However, as the temperature in the aging treatment was set at 350° C. for sample No. 1, it softened and the elongation thereof increased to 11%; while the tensile strength decreased to 121 MPa and sufficient strength was not obtained. Therefore, the temperature in the aging treatment may be preferable in a range of 100° C. to 300° C.

It has been discovered that the fabrication of the Al alloy wire from Al—Mg—Si alloy containing at least one element of Cu, Fe, Cr, Mn and Zr in the specific range can offer the Al alloy wire such characteristics as having a fine structure of the maximum grain size 50 μm or less, being extra fine with a wire diameter of ϕ0.5 mm or less, having a high strength and a high electrical conductivity, and being superior in elongation. Since the Al alloy wire is superior in elongation, impact resistance and flexing characteristics, it is expected that such Al alloy can be preferably used as an electrical wire conductor requiring high strength and electrical conductivity, for example, the wire conductor of a vehicular wire harness. Moreover, when the abovementioned extra fine wire is formed into the twisted wire or the compression wire, the wire constituting the twisted wire and the compression wire holds the composition, the structure and the mechanical characteristics of the above Al alloy wire, consequently, the twisted wire and the compression wire also have a high strength, a high electrical conductivity and a superior elongation; and moreover, twisting the wires together makes the electrical wire conductor further superior in flexing characteristics.

Example 2

The Al alloy wire was prepared and the high-temperature characteristics of the Al alloy wire were examined.

In the example, the Al alloy wire was prepared in the same order as Example 1 by using the molten Al alloy containing the additive elements (content in mass %) listed in Table 5. Specifically, the conditions from the melting step, the continuous casting-directed rolling step (ϕ9.5 mm), the homogenization step (530° C. for 5 hours, and the cooling speed of 0.89° C./min) to the elongation step (ϕ0.3 mm) were set identical to Example 1.

TABLE 5

| Sample No. | Si | Mg | Fe | Cu | Mn | Cr | Zr | Fe, Cu, Mn, Cr, Zr Sum | Ti | B |
|---|---|---|---|---|---|---|---|---|---|---|
| 2-1 | 0.41 | 0.51 | 0.15 | — | — | — | 0.07 | 0.22 | 0.01 | 0.002 |
| 2-2 | 0.55 | 0.67 | 0.14 | — | — | — | — | 0.14 | 0.02 | 0.004 |
| 2-3 | 0.52 | 0.68 | 0.13 | — | — | — | 0.02 | 0.15 | 0.02 | 0.004 |
| 2-4 | 0.52 | 0.67 | 0.15 | — | — | — | 0.03 | 0.18 | 0.02 | 0.004 |
| 2-5 | 0.53 | 0.66 | 0.14 | — | — | — | 0.06 | 0.20 | 0.02 | 0.004 |
| 2-6 | 0.52 | 0.68 | 0.14 | — | 0.05 | — | — | 0.19 | 0.02 | 0.004 |
| 2-7 | 0.56 | 0.67 | 0.15 | — | 0.10 | — | — | 0.25 | 0.02 | 0.004 |
| 2-8 | 0.50 | 0.65 | 0.13 | — | 0.15 | — | — | 0.28 | 0.02 | 0.004 |
| 2-9 | 0.52 | 0.62 | 0.14 | — | 0.21 | — | — | 0.35 | 0.02 | 0.004 |
| 2-101 | — | 0.15 | 1.05 | — | — | — | — | 1.05 | 0.02 | 0.004 |

With respect to the obtained elongated wire material having a final diameter of ϕ0.3 mm, the solution treatment according to any continuous processing approach of the ohmic heating approach, the high-frequency induction heating approach and the furnace heating approach by the use of a pipe furnace was performed to prepare the solution wire material. The solution conditions will be listed hereinafter.

The temperature of the wire material during the melting was always set around 600° C. (not less than 450° C.). After the wire material was heated for melting the wire material, it was cooled rapidly in a water tank (the cooling speed: 500° C./min (not less than 100° C./min)), similar to Example 1.

(Solution Conditions)

Ohmic heating approach:

wire transportation speed selected from 50-200 m/min current value selected from 33-66 A distance to water tank: 1.6 m High-frequency heating approach:

wire transportation speed selected from 200-1000 m/min current value: 100 A distance to water tank: 1.6 m Furnace heating approach:

wire transportation speed selected from 4-8 m/min temperature inside pipe furnace selected from 580-620° C.

distance to water tank: 2 m

The aging treatment was performed on the obtained solution wire material by using the box-typed furnace similar to Example 1 at various temperatures listed in Table 6 to prepare the aging wire material (Al alloy wire). The retention time was set at 12 hours for each temperature, and after the heating, the wire material was cooled in air atmosphere.

As a comparative wire material, sample No. 2-101 containing no Si was prepared. After the elongation, sample No. 2-101 was treated with the softening treatment (350° C. for 3 hours) but without neither the solution treatment nor the aging treatment.

For the obtained aging wire material (Al alloy wire) and the comparative wire material, the maximum grain size (μm), the tensile strength (MPa), the elongation (%) and the electrical conductivity (% IACS) were examined at room temperature (25° C.), similar to Example 1. The results are shown in Table 6. The maximum grain sizes listed in the following Tables 7 to 9 represent the measurement results of the aging wire material (Al alloy wire) and the comparative wire material.

TABLE 6

| Sample No. | Solution treatment | Aging treatment | Maximum grain size (μm) | Room Temperature Properties: Tensile strength (MPa) | Elongation (%) | Conductivity (% IACS) |
|---|---|---|---|---|---|---|
| 2-1 | high-frequency induction heating | 160° C. × 12 h | 30 | 226 | 9 | 54 |
| 2-2 | ohmic heating | 160° C. × 12 h | 30 | 248 | 11 | 52 |
| 2-3 | ohmic heating | 160° C. × 12 h | 35 | 250 | 10 | 54 |
| 2-4 | ohmic heating | 160° C. × 12 h | 31 | 239 | 10 | 53 |
| | | 180° C. × 12 h | 31 | 250 | 6 | 56 |
| 2-5 | pipe furnace | 160° C. × 12 h | 35 | 270 | 6 | 51 |
| 2-6 | ohmic heating | 160° C. × 12 h | 35 | 233 | 10 | 55 |
| 2-7 | ohmic heating | 160° C. × 12 h | 31 | 245 | 10 | 55 |
| | | 180° C. × 12 h | 31 | 240 | 5 | 57 |
| 2-8 | ohmic heating | 160° C. × 12 h | 30 | 241 | 10 | 53 |
| 2-9 | pipe furnace | 160° C. × 12 h | 35 | 291 | 13 | 48 |
| 2-101 | — | | 60 | 141 | — | — |

Similar to Example 1, it is obvious that each sample among samples No. 2-1 to No. 2-9 containing at least one element selected from Cu, Fe, Cr, Mn and Zr has a fine structure of the maximum grain size 50 μm or less and is superior in mechanical characteristics at room temperature by having the tensile strength of 150 MPa or more (each is not less than 200 MPa in the present example) and the elongation of 5% or more. It is also obvious that each sample among samples No. 2-1 to No. 2-9 has a high electrical conductivity as high as 40% IACS or more (each is not less than 48% IACS in the present example).

For the obtained aging wire material (Al alloy wire) and the comparative wire material, the tensile strength (MPa) at a temperature (° C.) selected from the temperature range of 80° C. to 150° C., the tensile strength (MPa) after being retained for 1000 hours at a temperature (° C.) selected from the temperature range of 80° C. to 150° C., and the tensile strength (MPa) after being retained for 3000 hours at a temperature (° C.) selected from the temperature range of 80° C. to 150° C. were examined according to Tables 7 to 9, respectively. The results are shown in Tables 7 to 9. The measurements were conducted by using a general tensile testing machine (equipped with an atmosphere furnace) capable of measuring the tensile strength at a temperature selected from the above temperature range. The measurements of the high-temperature strength as listed in Table 7 may be performed with reference to, for example, Japan Copper and Brass Association technical standards JCBA T313 (2002), JIS G 0567 (Method of elevated temperature tensile test for steels and heat-resisting alloys 1998) and the like. The tensile strength after being retained for 1000 hours at any temperature (° C.) listed in Table 8 and the tensile strength after being retained for 3000 hours at any temperature (° C.) listed in Table 9 were determined after the samples were cooled to room temperature after the predetermined retention time.

TABLE 7

| Sample No. | Solution treatment | Aging treatment | Maximum grain size (μm) | Tensile strength (MPa) at each temperature (° C.) 80° C. | 100° C. | 120° C. | 150° C. |
|---|---|---|---|---|---|---|---|
| 2-1 | high frequency induction heating | 160° C. × 12 h | 30 | — | — | — | — |
| 2-2 | ohmic heating | 160° C. × 12 h | 30 | 237 | 233 | 214 | 195 |
| 2-3 | ohmic heating | 160° C. × 12 h | 35 | — | — | — | — |
| 2-4 | ohmic heating | 160° C. × 12 h | 31 | 230 | 223 | 216 | 199 |
| | | 180° C. × 12 h | 31 | — | — | — | — |
| 2-5 | pipe furnace | 160° C. × 12 h | 35 | — | — | — | — |
| 2-6 | ohmic heating | 160° C. × 12 h | 35 | — | — | — | — |
| 2-7 | ohmic heating | 160° C. × 12 h | 31 | 227 | 217 | 210 | 197 |
| | | 180° C. × 12 h | 31 | — | — | — | — |
| 2-8 | ohmic heating | 160° C. × 12 h | 30 | — | — | — | — |
| 2-9 | pipe furnace | 160° C. × 12 h | 35 | — | — | — | — |
| 2-101 | — | | 60 | 138 | 136 | 127 | 113 |

TABLE 8

| Sample No. | Solution treatment | Aging treatment | Maximum grain size (μm) | Tensile strength (MPa) after being retained for 1,000 hrs. at each temperature (° C.) 80° C. | 100° C. | 120° C. | 150° C. |
|---|---|---|---|---|---|---|---|
| 2-1 | high-frequency induction heating | 160° C. × 12 h | 30 | — | — | — | 206 |
| 2-2 | ohmic heating | 160° C. × 12 h | 30 | 255 | 252 | 249 | 202 |
| 2-3 | ohmic heating | 160° C. × 12 h | 35 | — | — | — | 223 |
| 2-4 | ohmic heating | 160° C. × 12 h | 31 | — | — | — | 222 |
| | | 180° C. × 12 h | 31 | — | — | — | 216 |
| 2-5 | pipe furnace | 160° C. × 12 h | 35 | — | — | — | 237 |
| 2-6 | ohmic heating | 160° C. × 12 h | 35 | — | — | — | 208 |
| 2-7 | ohmic heating | 160° C. × 12 h | 31 | — | — | — | 220 |
| | | 180° C. × 12 h | 31 | — | — | — | 226 |
| 2-8 | ohmic heating | 160° C. × 12 h | 30 | — | — | — | 224 |
| 2-9 | pipe furnace | 160° C. × 12 h | 35 | — | — | — | 273 |
| 2-101 | — | | 60 | — | — | — | 138 |

TABLE 9

| Sample No. | Solution treatment | Aging treatment | Maximum grain size (μm) | Tensile strength (MPa) after being retained for 3,000 hrs. at each temperature (° C.) 80° C. | 100° C. | 120° C. | 150° C. |
|---|---|---|---|---|---|---|---|
| 2-2 | ohmic heating | 160° C. × 12 h | 30 | 252 | 247 | 243 | — |
| 2-101 | — | | 60 | — | — | — | 132 |

As shown in Table 7, it is obvious that the Al alloy wire, which contains at least one element selected from the specific elements of Cu, Fe, Cr, Mn and Zr, has the structure with the maximum grain size of 50 μm or less, is superior in the tensile strength and elongation at room temperature and has a high electrical conductivity, also has a tensile strength of 150 MPa or more at an arbitrary temperature selected from the temperature range of 80° C. to 150° C., which is superior in the high-temperature strength. It is considered the reason for this is in that by constructing the Al alloy wire with the structure having grains of a relatively great grain size (the maximum grain size in the example is about 30 μm to 40 μm) within the range of the maximum grain size of 50 μm or less as mentioned in the above, it is possible to inhibit the grain boundary sliding. The example reveals that the Al alloy wire has the tensile strength greater than 200 MPa at 80° C., and as the measuring temperature increases, although the tensile strength decreases to some extent, it still has the tensile strength of 150 MPa or more at a very high temperature of 150° C. Thereby, it can be concluded that the above Al alloy wire which is superior in the high temperature obviously has the tensile strength of 150 MPa or more at an arbitrary temperature (for example, 80° C., 85° C., 100° C., 120° C., 125° C., 150° C. or the like) selected from the temperature range of 80° C. to 150° C. and even at an arbitrary temperature from room temperature to 150° C.

As shown in Table 8, it is obvious that the Al alloy wire, which contains at least one element selected from the specific elements of Cu, Fe, Cr, Mn and Zr, has the fine structure with the maximum grain size of 50 μm or less, is superior in the tensile strength and the elongation at room temperature and has the high electrical conductivity, also has a tensile strength of 150 MPa or more after being retained for 1000 hours at an arbitrary temperature selected from the temperature range of 80° C. to 150° C., in other words, is superior in the high-temperature retention strength. It is considered the reason for this is in that by containing the above specific elements, the grain growth is inhibited even after being exposed to a high temperature for a long time, and thereby it is possible to maintain the fine structure (typically, the structure with the maximum grain size of 50 μm or less). In particular, it is obvious that sample No. 2-2 has the tensile strength of 150 MPa or more (over 200 MPa in the example) at any temperature within the temperature range of 80° C. to 150° C. although the tensile strength thereof decreases to some extent as the temperature increases within the temperature range. Thereby, it can be concluded that the Al alloy wire superior in the high temperature obviously has the tensile strength of 150 MPa or more after being retained for a long time at an arbitrary temperature (for example, 80° C., 85° C., 100° C., 120° C., 125° C., 150° C. or the like) selected from the temperature range of 80° C. to 150° C. and even after being retained for 1000 hours at an arbitrary temperature from room temperature to 150° C.

Further, as shown in Table 9, sample No. 2-2 after being retained for 3000 hours still have the tensile strength substantially equal to the tensile strength after being retained for 1000 hours. Thereby, it can be concluded that the Al alloy wire which has the strength of 150 MPa or more after being retained for 1000 hours at an arbitrary temperature selected from the temperature range of 80° C. to 150° C. can maintain the high strength even after being exposed to the same temperature for a longer time. It is considered the reason for this is in that the grain growth is inhibited by containing the specific elements as mentioned in the above.

Furthermore, by comparing Table 7 with Table 8, it is obvious that the tensile strength after being retained for 1000 hours at 150° C. is greater than the tensile strength at 150° C. One reason for this may be in that the tensile strength after being retained for 1000 hours at 150° C. is measured after being cooled to room temperature after a predetermined time. Another considerable reason may be in that the Al alloy wire is reinforced by the homogeneous dispersion of the precipitates after being exposed to the high temperature for a long time, i.e., being subjected to an ex-post aging treatment. Thereby, it is expected that the Al alloy wire which has the tensile strength of 150 MPa or more at an arbitrary temperature selected from the temperature range of 80° C. to 150° C. can maintain the high strength over time in an environment of usage with the temperature thereof rising to the high temperature or falling into a low temperature state with the temperature thereof dropping from the high-temperature state to room temperature or around the same will maintain the high strength over time or even has the strength further improved.

It is obvious that since any of sample No. 2-1 and samples No. 2-3 to No. 2-9 have the tensile strength of 150 MPa or more (200 MPa or more in each example) after being retained for 1000 hours at 150° C., they are superior in the high-temperature retention strength similar to sample No. 2-2. Further, similar to sample No. 2-2, it is expected that any of sample No. 2-1 and samples No. 2-3 to No. 2-9 have: (1) the tensile strength of 150 MPa or more after being retained for 1000 hours at an arbitrary temperature selected from the temperature range of 80° C. to 150° C. and at an arbitrary temperature from room temperature to 150° C., (2) the tensile strength of 150 MPa or more after being further retained for 3000 hours at the selected arbitrary temperature, and (3) an improved strength when exposed to the selected arbitrary temperature in using.

It should be noted that the present invention is not limited to the embodiments described above and appropriate modifications may be performed without departing from the scope of the gist of the present invention. For example, the composition of the Al alloy wire, the wire diameter of the Al alloy wire, the solution treatment conditions and the like may be modified in specific ranges.

INDUSTRIAL APPLICABILITY

The aluminum alloy wire of the present invention and the aluminum alloy twisted wire of the present invention can be preferably applied to the usage requiring light weight, high strength and high electrical conductivity and superior impact resistance and flexing characteristics, such as a wire conductor in a wiring structure of various electrical devices including transportation devices such as a motor vehicle, an air plane and the like and a control device such as an industrial robot or the like. Moreover, the aluminum alloy wire of the present invention and the aluminum alloy twisted wire of the present invention can be preferably used as a wire conductor in the usage requiring superior high-temperature strength and heat resistance. The covered electrical wire of the present invention can be preferably used as an electrical wire in a wiring structure of various electrical devices such as the vehicular wire harness and the like. The wire harness of the present invention can be preferably used in electrical devices of various fields requiring light weight, and particularly in a wiring structure of a motor vehicle requiring light weight so as to improve the fuel efficiency and in a wiring structure of a motor vehicle to be disposed at a location such as the periphery of an engine, the temperature of which may increase to a high temperature.

The invention claimed is:

1. An aluminum alloy wire to be used as a conductor, containing in mass %:

Mg at 0.2% to 1.5%;

Si at 0.1% to 2.0%;

Fe at 0.1% to 1.0%, or at least one element selected from Cu, Cr, Mn and Zr, and Fe at a total of 0.1% to 1.0%;

Ti at 0.005% to 0.08% and B at 0.0005% to 0.016%;

Zr at 0.02% to 0.40% and Mn at 0.05% to 0.40%; and the balance being Al and impurities, wherein the content of the Mg is greater than the content of at least one of the Fe, Cu, Cr, Mn, and Zr, wherein the content of the Si is greater than the content of the Fe, and having:

an electrical conductivity of 40% IACS or more;

a tensile strength of 150 MPa or more;

an elongation of 5% or more;

a wire diameter of 0.5 mm or less; and a maximum grain size of 50 μm or less, wherein a ratio of the maximum grain size relative to the wire diameter is less than 10%.

2. The aluminum alloy wire according to claim 1, wherein the tensile strength after being retained for 1000 hours at an arbitrary temperature selected from a temperature range of 80° C. to 150° C. is 150 MPa or more.

3. The aluminum alloy wire according to claim 1, wherein the tensile strength at an arbitrary temperature selected from a temperature range of 80° C. to 150° C. is 150 MPa or more.

4. An aluminum alloy twisted wire obtained by twisting together a plurality of the aluminum alloy wires according to claim 1.

5. A covered electrical wire including a conductor and an insulation covering layer on an outer periphery of the conductor, wherein:

the covered electrical wire includes the aluminum alloy wire according to claim 1, and wherein the aluminum alloy wire comprises an aluminum alloy twisted wire obtained by twisting together a plurality of the aluminum alloy wires, or a compression wire obtained by compression molding the aluminum alloy twisted wire.

6. A wire harness including the covered electrical wire according to claim 5 and a terminal section installed at an end portion of the covered electrical wire.

* * * * *